US008967498B2

(12) United States Patent
Egli

(10) Patent No.: US 8,967,498 B2
(45) Date of Patent: Mar. 3, 2015

(54) DEVICE FOR SPRAYING A LIQUID UNDER PRESSURE

(75) Inventor: Werner Egli, Eglisau (CH)

(73) Assignee: Neoperl International AG, Reinach (CH)

( * ) Notice: Subject to any disclaimer, the term of this patent is extended or adjusted under 35 U.S.C. 154(b) by 117 days.

(21) Appl. No.: 13/882,302

(22) PCT Filed: Sep. 23, 2011

(86) PCT No.: PCT/CH2011/000226

§ 371 (c)(1), (2), (4) Date: Apr. 29, 2013

(87) PCT Pub. No.: WO2012/055051

PCT Pub. Date: May 3, 2012

(65) Prior Publication Data

US 2013/0221132 A1 Aug. 29, 2013

(30) Foreign Application Priority Data

Oct. 28, 2010 (CH) ..... 1804/10

(51) Int. Cl.
*B05B 1/34* (2006.01)
*B05B 1/14* (2006.01)
(Continued)

(52) U.S. Cl.
CPC . *B05B 1/341* (2013.01); *B05B 1/26* (2013.01); *B05B 1/3431* (2013.01); *B05B 15/008* (2013.01); *E03C 1/08* (2013.01); *B05B 1/18* (2013.01); *Y10S 239/17* (2013.01)
USPC ..... 239/490; 239/468; 239/600; 239/DIG. 17

(58) Field of Classification Search
CPC ..... E03C 1/08; E03C 1/084; E03C 1/086; B05B 1/14; B05B 1/18; B05B 1/185; B05B 1/3405; B05B 1/341; B05B 1/3421; B05B 1/3426; B05B 1/3431; B05B 1/3436; B05B 1/3463
USPC ..... 239/428.5, 463, 468, 469, 486, 490, 239/548, 596, 600, DIG. 17
See application file for complete search history.

(56) References Cited

U.S. PATENT DOCUMENTS 2,651,547 A * 9/1953 Calhoun ..... 239/490
2,761,737 A 9/1956 Nurkiewica
(Continued)

FOREIGN PATENT DOCUMENTS

DE 69306596 7/1997
DE 60217585 10/2007
(Continued)

*Primary Examiner* — Darren W Gorman
(74) *Attorney, Agent, or Firm* — Volpe and Koenig, P.C.

(57) ABSTRACT

A device is disclosed which is intended for spraying a pressurized liquid, in particular water, and brings about a good cleaning action despite a low volume flow. The device comprises a plurality of swirl chambers (14), wherein each of the swirl chambers has at least one inlet for feeding the liquid into the respective swirl chamber and an outlet nozzle (18) in order for a liquid jet to exit from the swirl chamber. A liquid stream entering into the device is distributed between the inlets of the swirl chambers by means of an arrangement of inflow channels. The outlet nozzles are inclined in relation to one another such that the exiting liquid jets come into contact with one another at a predetermined distance from the outlet nozzles. This achieves an improved cleaning action. The device may be designed, for example, as a mouthpiece for a sanitary outflow fitting, as a showerhead, etc.

20 Claims, 6 Drawing Sheets

(51) Int. Cl.

| | |
|---|---|
| ***B05B 1/18*** | (2006.01) |
| ***E03C 1/08*** | (2006.01) |
| ***B05B 1/26*** | (2006.01) |
| ***B05B 15/00*** | (2006.01) |

(56) References Cited

U.S. PATENT DOCUMENTS

| | | | | |
|---|---|---|---|---|
| 5,358,179 | A | 10/1994 | Lund et al. | |
| 5,516,045 | A | 5/1996 | Baudin | |
| 6,036,479 | A | 3/2000 | Dubach et al. | |
| 6,142,390 | A * | 11/2000 | Nordstrom et al. | 239/490 |
| 7,478,769 | B1 * | 1/2009 | Pautsch et al. | 239/555 |
| 2003/0025001 | A1 | 2/2003 | De Laforcade | |

FOREIGN PATENT DOCUMENTS

| | | |
|---|---|---|
| EP | 0924461 | 6/1999 |
| EP | 1277516 | 1/2003 |
| RU | 2196205 | 1/2003 |
| WO | 9323174 | 11/1993 |
| WO | 2007062536 | 6/2007 |
| WO | 2008073062 | 6/2008 |

* cited by examiner

DEVICE FOR SPRAYING A LIQUID UNDER PRESSURE

BACKGROUND

The present invention relates to a device which is used for spraying a pressurized liquid, in particular water, and which can achieve a very good cleaning effect despite a very low volume flow. Such a device may be designed, in particular, as a mouthpiece for sanitary outflow fittings or as an insert for a showerhead or the like.

In many areas on Earth, water is a precious commodity which has to be used sparingly. Devices which limit the volume flow of the water running through outflow fittings, showerheads, or the like can make an important contribution here. It is also the case in aircraft, camper vehicles, etc., that it may be important to be economical with the water available.

Nowadays, sanitary outflow fittings usually have mouthpieces inserted therein which mix air into the water as it exits. On one hand, this makes the outflowing jets pleasantly soft. On the other hand, it can significantly reduce the volume flow of water. Typical values for the volume flow (the flow rate) are currently approximately 12 l/min (liters per minute) for bathroom vanities. So-called economy nozzles can reduce this value to approximately 6-8 l/min. However, significantly lower volume flows are still desirable.

For this purpose, the prior art has proposed introducing the water into a swirl chamber in which the water is made to execute a swirling movement. Subsequent axial acceleration through a nozzle opening generates a finely dispersed jet, which gives a good cleaning action even in the case of a low volume flow.

Such a swirl chamber is disclosed, for example, in RU 2 196 205. The swirl chamber presented therein is conical. The water is fed to the swirl chamber, in the region of the largest cross section of the cone, through a tangential inflow channel and leaves the swirl chamber through an axial outlet channel.

A swirl chamber is also disclosed in WO 2008/073062. This document discloses a mouthpiece which is intended for a sanitary outflow fitting and can be switched between an economy mode and a normal mode. In economy mode, the water is introduced tangentially through two channels, from opposite sides, into a short, cylindrical swirl chamber, from which it exits axially through a central outlet opening. In normal mode, in contrast, the water bypasses the swirl chamber to reach the central outlet opening and also a plurality of further, decentralized outlet openings, and therefore a very much greater volume flow is achieved.

While the use of a swirl chamber can help reduce the volume flow greatly, the cleaning action which can be achieved thereby can still be improved.

A quite different approach has been pursued in WO 2007/062536. That document has proposed, among other things, allowing two water jets to strike against one another at high speed, and at a relatively large angle, to form a thin disc of water. This disc disperses at a certain distance from the point of impact to form fine droplets. A disadvantage with this device is that the water requires a very high pressure in order to ensure sufficient atomization. The document mentions a preferred pressure range of 15-25 bar, whereas the normal mains pressure is merely approximately 2-5 bar. This usually necessitates the use of a separate pump. The high pressure and the resulting extremely high exit speed of the water jets also requires special measures in order to prevent the situation where the water jets come into direct contact with the user's skin or eyes without having been atomized beforehand.

U.S. Pat. No. 5,358,179 discloses a spray head which is intended for spraying high-viscosity liquids and, in one embodiment, has swirl chambers. The liquid jets exiting from the swirl chambers then come into contact with one another.

EP 1 277 516 and WO 93/23174 each disclose a spray head with two nozzles, which have swirl channels and are directed towards one another such that the resulting jets come into contact with one another.

SUMMARY

It is an object of the present invention to provide a device which is intended for spraying a pressurized liquid, can be operated at a normal mains pressure of approximately 2-5 bar, and brings about an improved cleaning action despite a low volume flow. It is also intended for the device to be capable of being produced straightforwardly and cost-effectively in large numbers. This object is achieved by a device having one or more of the features of the invention. Further embodiments are specified below and in the claims.

The device according to the invention thus comprises:

a plurality of swirl chambers, wherein each of the swirl chambers has at least one inlet for feeding the liquid into the respective swirl chamber and also an outlet nozzle in order for a liquid jet to exit from the swirl chamber; and an arrangement of inflow channels, in order for a liquid stream entering into the device to be distributed between the inlets of the swirl chambers.

Each of the outlet nozzles here defines a longitudinal nozzle axis (in the case of an at least partially cylindrical outlet nozzle, the longitudinal nozzle axis is identical to the cylinder axis). The longitudinal nozzle axes are inclined in relation to one another such that liquid jets exiting from the outlet nozzles come into contact with one another at a predetermined distance from the outlet nozzles. This can be achieved, in particular, in that the longitudinal nozzle axes intersect outside the device essentially at a point of intersection which is at the aforementioned distance from the outlet nozzle.

In this manner a device is provided which, as compared to a single swirl chamber, gives rise to a considerably improved cleaning action, while simultaneously maintaining a low volume flow. If use is made, for example, of three swirl chambers, it is possible, with a normal mains pressure of approximately 3 bar and an overall volume flow of just 0.6 l/min, to achieve an excellent cleaning action for hand-washing purposes. Since the liquid jets, thanks to the swirl chambers, are already in finely dispersed form when they leave the outlet nozzles, there is no problem at all if these jets come into contact with a user's skin before the jets come into contact with one another.

The device can be used in a wide variety of different ways. It is thus possible for the device to be designed, for example, as a mouthpiece for a sanitary outflow fitting for hot or cold tap water, e.g., in a bathroom vanity or bidet. However, it is also possible for the device to be used, for example, as a spray head of a bidet, as a showerhead of a normal shower fitting, as an exchangeable insert of such a showerhead, as a spray head in a spa facility, etc. It is also possible for the device to be used, for example, in camping, for example in a motor home or recreational vehicle, or in bathroom vanities or even showers on aircraft. The liquid which is to be sprayed need not necessarily be water; rather, it may also be, for example, a cleaning solution containing detergents. Ultimately, the invention can advantageously be used in all applications in which it is desirable to have a good cleaning performance while maintaining a low volume flow.

The device preferably has at least three swirl chambers with associated outlet nozzles. The liquid jets from these outlet nozzles come into contact with one another. An expedient upper limit for the number of swirl chambers here would appear to be approximately ten. The swirl chambers and outlet nozzles are preferably arranged in the form of a ring around a central longitudinal device axis. The outlet nozzles are then preferably distributed uniformly in the circumferential direction of the ring. It is also possible, however, for other arrangements to be selected.

The axial distance from the outlet nozzles, where the liquid jets come into contact with one another, is preferably between 40 mm and 150 mm, although this value may also be greater depending on the application. For use in sanitary outflow fittings, a distance of approximately 80 mm is preferred. In the case of typical dimensions of mouthpieces for sanitary outflow fittings and of an annular arrangement of the outlet nozzles, this distance corresponds to an angle of inclination of the longitudinal nozzle axes relative to the central longitudinal device axis of approximately 3°. However, depending on the dimensions of the device and on the application envisaged, this angle of inclination may also be greater or smaller, in particular approximately 1°-10°, preferably approximately 2°-5°.

A swirl chamber in this document is understood to be a chamber by means of which, on account of its geometry, water entering through an inlet is made to execute a swirling movement about a swirling axis (that is to say is made to generate a vortex about the swirling axis), the chamber having an outlet nozzle such that the water exits essentially axially in relation to the swirling axis. The swirl chamber is designed preferably as follows. The swirl chamber defines a longitudinal chamber axis. The inlet of the swirl chamber is formed in an inflow region of the swirl chamber such that the liquid is fed into the swirl chamber essentially tangentially in relation to the longitudinal chamber axis. The outlet nozzle, in contrast, is arranged essentially centrally in relation to the longitudinal chamber axis. The longitudinal nozzle axis and the longitudinal chamber axis either run coaxially or enclose an angle of at most 15°, preferably at most 10°, particularly preferably at most 5°, in relation to one another. In an embodiment which is particularly preferred in production terms, the longitudinal chamber axes of the swirl chambers run essentially parallel to one another, and in particular parallel to a common longitudinal device axis, whereas the longitudinal nozzle axes are inclined in relation to the longitudinal chamber axes and/or the longitudinal device axis.

The outlet nozzle is preferably spaced apart axially from the inflow region, as seen in relation to the longitudinal chamber axis. The swirl chamber then preferably tapers in a funnel-like manner between the inflow region and the outlet nozzle. For this purpose, each of the swirl chambers preferably has an essentially conical region in which the cross section of the swirl chamber tapers continuously along the longitudinal chamber axis to the outlet nozzle. An essentially cylindrical region may be arranged axially upstream in relation to this conical region, the essentially cylindrical region being arranged between the inflow region and the conical region. This means that liquid enters in the first instance tangentially into the inflow region, describes a helical movement through the cylindrical region, and is accelerated further in the conically tapering region before the resulting vortex enters into the outlet nozzle. This results in the liquid jet being dispersed particularly efficiently as it leaves the outlet nozzle. "Essentially cylindrical" here is also to be regarded as covering shapes which deviate slightly from a purely cylindrical shape without significantly altering the function of this region, e.g., frustoconical shapes with a small opening angle, in particular if the opening angle (angle between diametrically opposite lateral-surface regions) is smaller than 2×10° or even smaller than 2×5°.

In order to improve the vortex formation, each of the swirl chambers may contain a protuberance which extends centrally along the longitudinal chamber axis into the inflow region of the swirl chamber, and therefore the inflow region of the swirl chamber forms an annular cavity. The protuberance here is preferably cylindrical, but may also be, for example, frustoconical.

The outlet nozzles are formed preferably by cylindrical bores. However, even if the outlet nozzles should be of some other shape, preferably each outlet nozzle has, at its end, a cylindrical exit region followed in the outward direction by an essentially planar exit surface running orthogonally to the cylinder axis. In particular, the outlet nozzle preferably does not widen outwards at its outer end. A sharp edge is preferably formed between the exit region and the associated exit surface, in order to facilitate the separation of the liquid jet from the outlet nozzle. This results overall in a clearly defined jet pattern.

It is preferable for the swirl chambers, but at least the outlet nozzles, to be formed in a common (preferably single-piece) swirl-chamber element. In this case, it is preferred in terms of production if the swirl-chamber element has, on its outside, in the region of each outlet nozzle, a shallow, preferably frustoconical depression which has a cone axis coinciding with the nozzle axis and which forms the exit surface.

For the purpose of feeding the liquid, the device preferably has a central feed channel which is used for the liquid, runs along a device axis, and optionally tapers in the axial direction, in order to achieve initial acceleration of the liquid stream entering the device. The swirl chambers are then arranged preferably in a decentralized manner in relation to the device axis, e.g., in the form of a ring around the device axis, and the inflow channels connect the feed channel to the swirl chambers essentially transversely to the device axis. Improved vortex formation can be achieved if each of the inflow channels, starting from the feed channel, describes an arc with an angle of at least 90°. However, it is also possible to provide inflow channels of some other shape, e.g., rectilinear or fanlike inflow channels, as will be described in more detail below. In order to achieve a clearly defined jet pattern, it is preferred if each of the inflow channels has a rectangular cross section. It is preferred here if the cross section is essentially constant over the length of the inflow channel.

It should be noted here that the cross-sectional area of the inflow channels has a significant influence on the volume flow at a given operating pressure. It is thus possible, at a given operating pressure, to set the volume flow by a suitable selection of the cross-sectional area of the inflow channels. This means that there is no need to use a separate flow restrictor.

The device can be produced particularly straightforwardly if it comprises a (preferably single-piece) feed element and a (preferably likewise single-piece) swirl-chamber element, which are connected to one another, in particular rest one upon the other, such that, together, they bound at least one region of each inflow channel, wherein the swirl chambers are formed, at least in part, by depressions (e.g., bores) in the swirl-chamber element. It is preferred here if the swirl-chamber element and the feed element have their end sides, as seen in relation to the longitudinal device axis, resting one upon the other, i.e., if they rest one upon the other essentially along a common plane running perpendicularly to the longitudinal device axis. In particular, it is preferred if the inflow channels are formed by depressions (e.g., grooves) in the feed element, whereas the swirl-chamber element has an end surface which is oriented towards the feed element and is essentially planar in the region of the inflow channels, in order thus to bound the in flow channels together with the feed element. In this embodiment, it is also possible for the device to be adapted, in particular, very straightforwardly to various pressure ranges merely by the feed element being exchanged for another feed element with a different cross-sectional surface area for the inflow channels, whereas, the swirl-chamber element can remain the same irrespective of the pressure range.

In order for the feed element and the swirl-chamber element to be positioned correctly relative to one another, and to be prevented from rotating in relation to one another, at least one decentralized positioning protuberance may be formed on the feed element or swirl-chamber element. This positioning protuberance engages in a complementary positioning groove on the other element. Such positioning, however, may also be achieved in other ways, e.g., by the provision of laterally interrupted hollow stubs which are formed on the feed element and project, in a region surrounding the inflow region of the swirl chambers, into depressions of the swirl-chamber element.

The feed element and the swirl-chamber element may be retained together in an accommodating sleeve such that the feed element, the swirl-chamber element, and the accommodating sleeve together form an exchangeable unit ("service unit"). For this purpose, the swirl-chamber element may butt against an inner axial stop of the accommodating sleeve (possibly with a seal arranged in-between), whereas the feed element rests on the swirl-chamber element and is retained on the accommodating sleeve, e.g., by a snap-fit connection. For this purpose, one or more snap-fit arms may be formed on the feed element, for engagement in corresponding inner depressions in the accommodating sleeve.

BRIEF DESCRIPTION OF THE DRAWINGS

Preferred embodiments of the invention will be described below with reference to the drawings, which serve merely for explanatory purposes and should not be interpreted in any restrictive manner. In the drawings.

DETAILED DESCRIPTION OF THE PREFERRED EMBODIMENT

Figure 1:
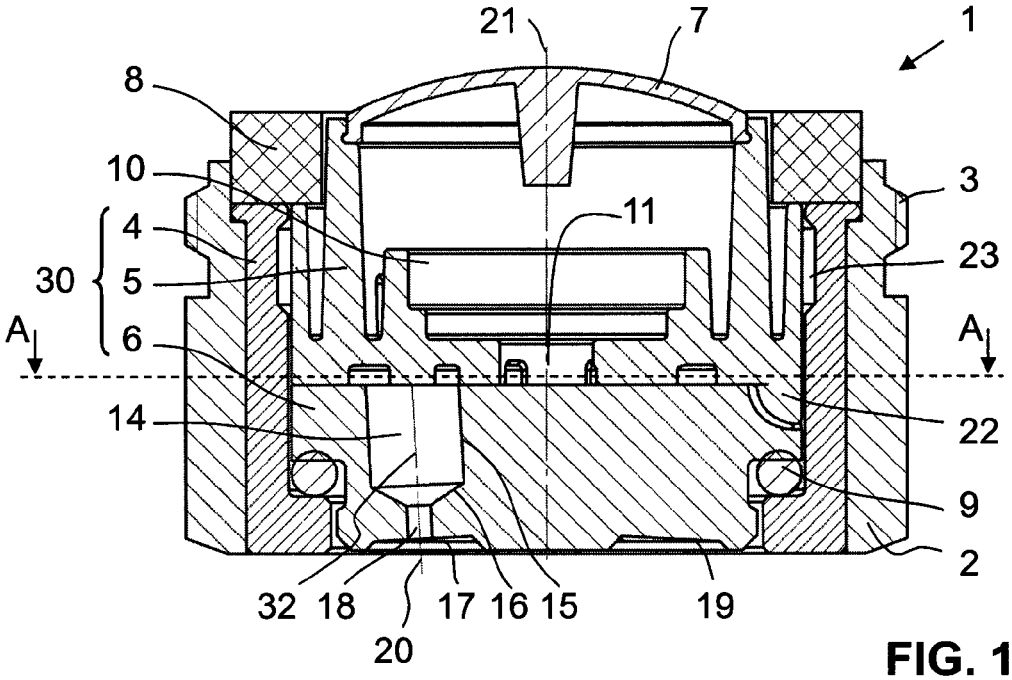
FIG. 1 shows a mouthpiece according to a first embodiment of the invention as seen in a central longitudinal section.
Figure 2:
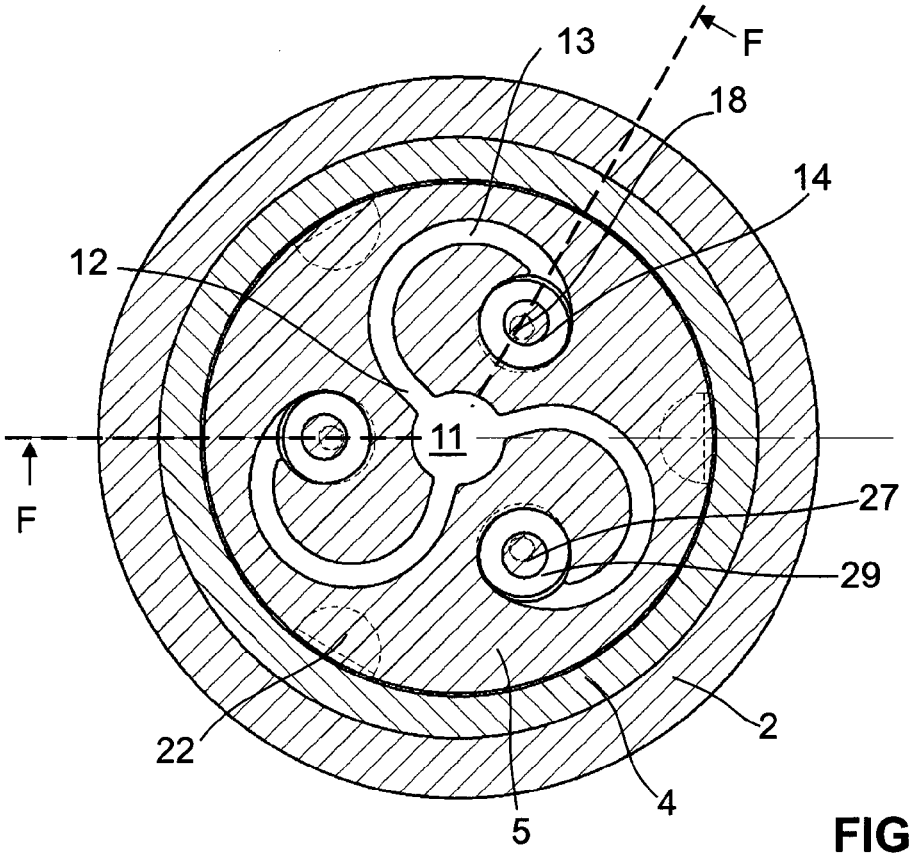
FIG. 2 shows the mouthpiece from FIG. 1 as seen in a cross section along plane A-A from FIG. 1.
Figure 5:
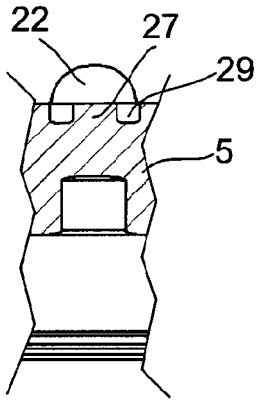
FIG. 5 shows a detail of the housing insert from FIG. 3 as seen in a longitudinal section along plane C-C from FIG. 3.
Figure 6:
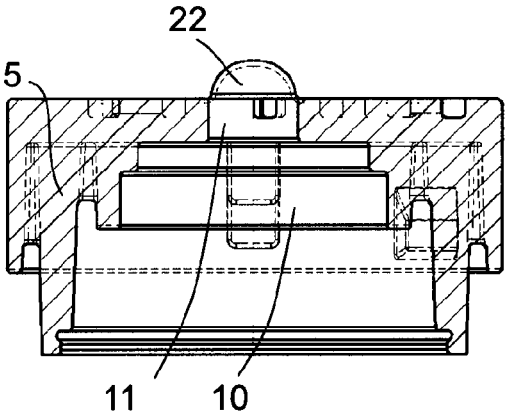
FIG. 6 shows a central longitudinal section of the housing insert from FIG. 3 taken along plane D-D from FIG. 3.
Figure 4:
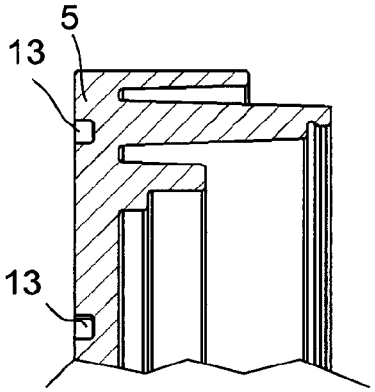
FIG. 4 shows a detail of the housing insert from FIG. 3 as seen in a longitudinal section along plane B-B from FIG. 3.
Figure 3:
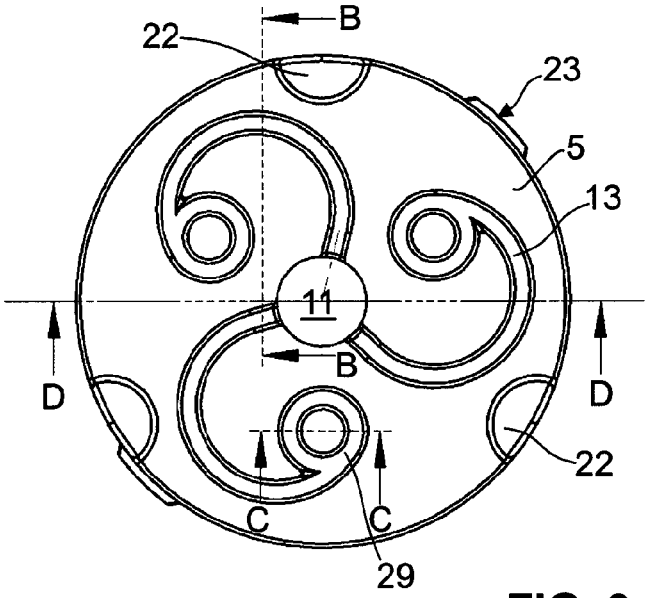
FIG. 3 shows the housing insert of the mouthpiece from FIG. 1 in a view from beneath.

FIGS. 1 and 2 illustrate a mouthpiece 1 of a sanitary outflow fitting according to a first embodiment of the invention. An outer sleeve 2 has a connection thread 3, which fits into commercially available bathroom vanity fittings. The outer sleeve accommodates an accommodating sleeve, referred to below as inner sleeve 4, a feed element, referred to below as housing insert 5, and a swirl-chamber element, referred to below as swirl plate 6. These parts are produced preferably from a material which repels dirt and calcium carbonate. In particular, the housing insert 5 and/or the swirl plate 6 may be produced by injection molding from plastics. The housing insert 5 is additionally illustrated, on its own, in various views in FIGS. 3 to 6. A particle filter 7, which is snap-fitted into the housing insert 5, prevents particles of dirt or sand from penetrating into the mouthpiece. A seal 8 in the form of a sealing ring with a square or rectangular cross section produces sealing between the outflow fitting section and the interior of the inner sleeve 4. A further seal 9 in the form of an O-ring produces sealing between the inner sleeve 4 and the swirl plate 6.

The housing insert 5 contains a central bore 10, which tapers downwards in a stepwise manner to a cylindrical feed channel 11. The cylinder axis of the bore 10 defines a central longitudinal device axis 21.

From the feed channel 11, three inflow channels 13 extend, transversely to the longitudinal device axis 21, to three decentralized swirl chambers 14 arranged in the form of a ring around the longitudinal device axis. Each of the inflow channels 13 here runs in the first instance essentially radially outwards in a radial portion 12 and then describes an arc of somewhat more than 180°, before opening out tangentially into the respective swirl chamber 14. The inflow channels here are designed as depressions of rectangular cross section in that end side of the housing insert 5 which is located opposite the swirl plate 6. The opposite end side of the swirl plate 6, in contrast, is formed in a planar and smooth manner in the region of the inflow channels 13. In this way, the housing insert 5 and the swirl plate 6 together bound the inflow channels 13.

Each of the swirl chambers 14 has an inflow region 29, into which the associated inflow channel 13 opens essentially tangentially. The inflow region 29 here is formed in the housing insert 5 as an annular cavity of rectangular cross section. The center of the inflow region 29 contains a cylindrical stub 27, which is formed on the housing insert 5 and extends into the inflow region from above. The length of the stub here corresponds essentially to the height of the inflow channels, and therefore the stub terminates axially in the common plane separating the housing insert 5 and the swirl plate 6. The inflow region 29 is followed axially by a cylindrical region 15 (transition region) in the form of a cylindrical bore in the swirl plate 6, this cylindrical region being followed, in turn, by a conically tapering region 16. The conically tapering region 16 opens out into a centrally arranged, axially running, cylindrical outlet nozzle 18. The outlet nozzle 18 terminates at an exit surface 17 running at right angles to the cylinder axis of the nozzle, wherein a sharp edge is formed between the cylindrical nozzle bore and the exit surface. The exit surface is formed by a shallow, frustoconical depression 19 in the outer end surface of the swirl plate 6, and is thus annular.

The cylinder axis of each swirl chamber 14 defines a longitudinal chamber axis 32. Similarly, the cylinder axis of the associated outlet nozzle 18 defines a longitudinal nozzle axis 20. In the present example, the longitudinal chamber axis 32 and the longitudinal nozzle axis 20 coincide and, together, are inclined by approximately 3° in relation to the longitudinal device axis 21. The longitudinal nozzle axes 20 thus meet at a common point of intersection at a distance of approximately 80 mm from the exit surface of the nozzles. However, it is also possible for the longitudinal chamber axis and the longitudinal nozzle axis to assume a small angle in relation to one another. This will be explained in more detail below in conjunction with FIG. 12.

The housing insert 5 has formed, along its outer circumference, three protuberances 22 which project axially in the direction of the swirl plate 6 and engage in complementary grooves on the outside of the swirl plate 6, in order for the swirl plate 6 and the housing insert 5 to be positioned correctly in relation to one another and secured against rotation. The housing insert 5 and the swirl plate 6 are retained together in the inner sleeve 4. For this purpose, the swirl plate 6 has formed on it an inwardly offset step which is oriented in the outlet direction and rests on the seal 9; this seal rests, in turn, on an inwardly oriented annular flange at the outlet end of the inner sleeve 4. The housing insert 5 is pushed onto the swirl plate 6. The housing insert is fixed on the inner sleeve 4 via snap-fit arms 23, which will be described in more detail below and engage in a corresponding aperture on the inside of the inner sleeve 4. Consequently, the inner sleeve 4, the housing insert 5 and the swirl plate 6, together with the seal 9 and the particle filter 7 form a service unit 30 which is easy to exchange.

During operation, water enters axially through the particle filter 7 (of which the mesh width is smaller than the smallest cross-sectional dimension of the inflow channels 13 and of the outlet nozzles 18) into the central bore 10 and, from there, into the feed channel 11. The tapering shape of the central bore 10 means that the water stream is accelerated here for a first time. In the feed channel 11, the water is distributed between the inflow channels 13 and deflected in the process. The water is guided through the inflow channels 13 to the swirl chambers 14. The water enters tangentially into the inflow region 29 of each swirl chamber 14 and begins to describe a helical movement there. The central protuberance 27 in the inflow region here additionally assists the formation of a swirling movement. The resulting vortex then moves downwards along the cylindrical region 15 and is accelerated further in the conically tapering region 16, before it enters into the outlet nozzle 18. The water leaves the outlet nozzle 18 at high speed and is dispersed into fine droplets in the process. The sharp-edged formation of the transition between the cylindrical nozzle bore and the exit surface 17 here assists in achieving a clearly defined separation of the water jet. This gives rise to a finely dispersed, directed jet, without non-directed spray mist being formed to any excessive extent. These already previously dispersed water jets come into contact with one another at the point of intersection of the longitudinal nozzle axes approximately 80 mm beneath the exit surface, and ensure optimum cleaning performance in this region. It is thus possible, for example, for the hands to be fully wetted for washing purposes, and it is also possible for soap or other cleaning agents to be readily washed off the hands again.

In the case of a mouthpiece for use on bathroom vanities, the dimensions of the mouthpiece may be selected, for example, as follows: external diameter of the mouthpiece approximately 24 mm; distance between the nozzle outlets and the central longitudinal device axis approximately 4.2 mm; angle of inclination of the longitudinal nozzle axis and of the longitudinal chamber axis in relation to the longitudinal device axis approximately 3°; cross section of the inflow channels rectangular, approximately 1 mm in width and 0.5 mm in depth; the volume flow resulting for a flow pressure of 3 bar is approximately 0.2 l/min for each outlet nozzle (total volume flow approximately 0.6 l/min). Of course, it is possible for these parameters to be varied within wide ranges. In particular, it is possible, at a predetermined flow pressure, to set a relatively high or low volume flow by suitable selection of the cross-sectional surface area of the inflow channel or, in the case of a predetermined volume flow, it is possible for the mouthpiece to be adapted to different pressure conditions.

Figure 7:
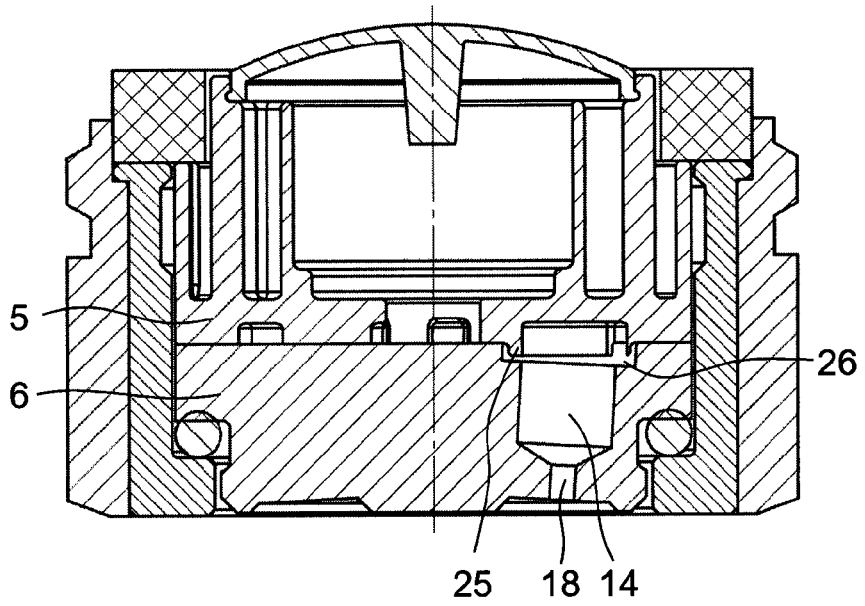
FIG. 7 shows a mouthpiece according to a second embodiment of the invention as seen in a central longitudinal section.
Figure 8:
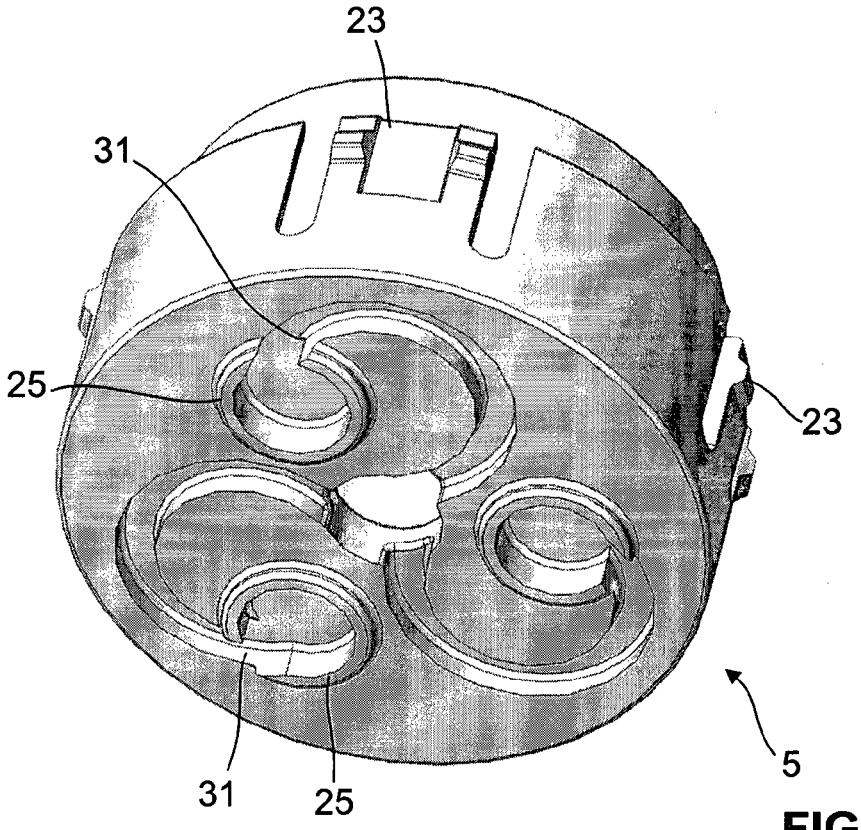
FIG. 8 shows a perspective view of the housing insert of the mouthpiece from FIG. 7.

A mouthpiece according to a second embodiment of the invention is illustrated in FIGS. 7 and 8. The construction of this mouthpiece corresponds largely to that of the first embodiment, and equivalent parts are provided with the same reference numerals as in the first embodiment. In particular FIG. 8 clearly shows the snap-fit arms 23 on the housing insert 5, these establishing the already mentioned snap-fit connection together with the inner sleeve.

This embodiment differs from the first embodiment, in particular, by the manner in which the housing insert 5 and the swirl plate 6 are secured against rotation relative to one another. The positioning aids used here are hollow stubs 25 on the housing insert 5, the stubs projecting axially beyond the end surface of the housing insert 5 and surrounding the inflow regions of the swirl chambers. These hollow stubs project into short blind bores 26, which are formed in the swirl plate 6. In order to allow the water to be fed tangentially into the swirl chamber, each hollow stub 25 is interrupted by a through-passage 31. This embodiment, moreover, does away with the central stub 27, which in the first embodiment projects axially into the inflow region 29 of the swirl chamber 14.

Figure 9:
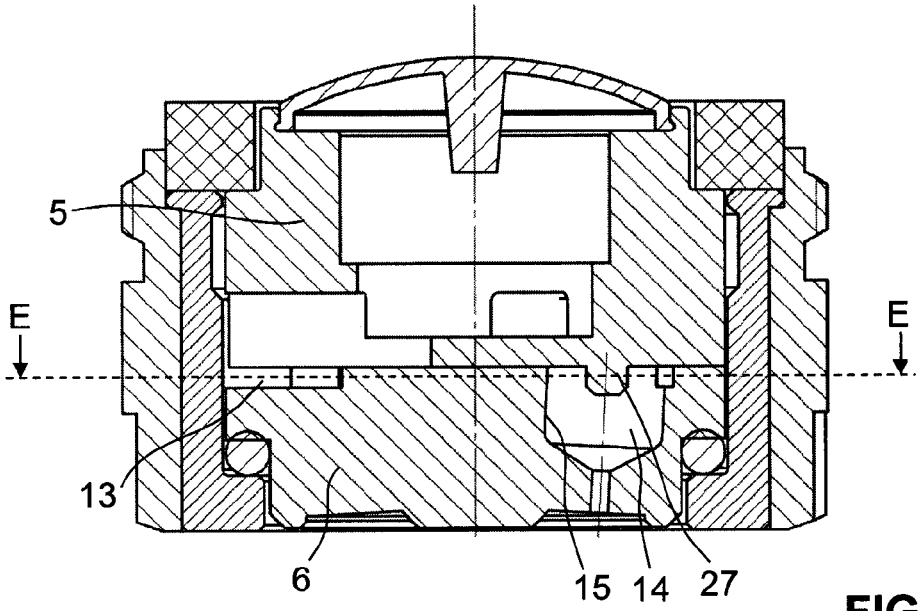
FIG. 9 shows a mouthpiece according to a third embodiment of the invention as seen in a central longitudinal section.
Figure 10:
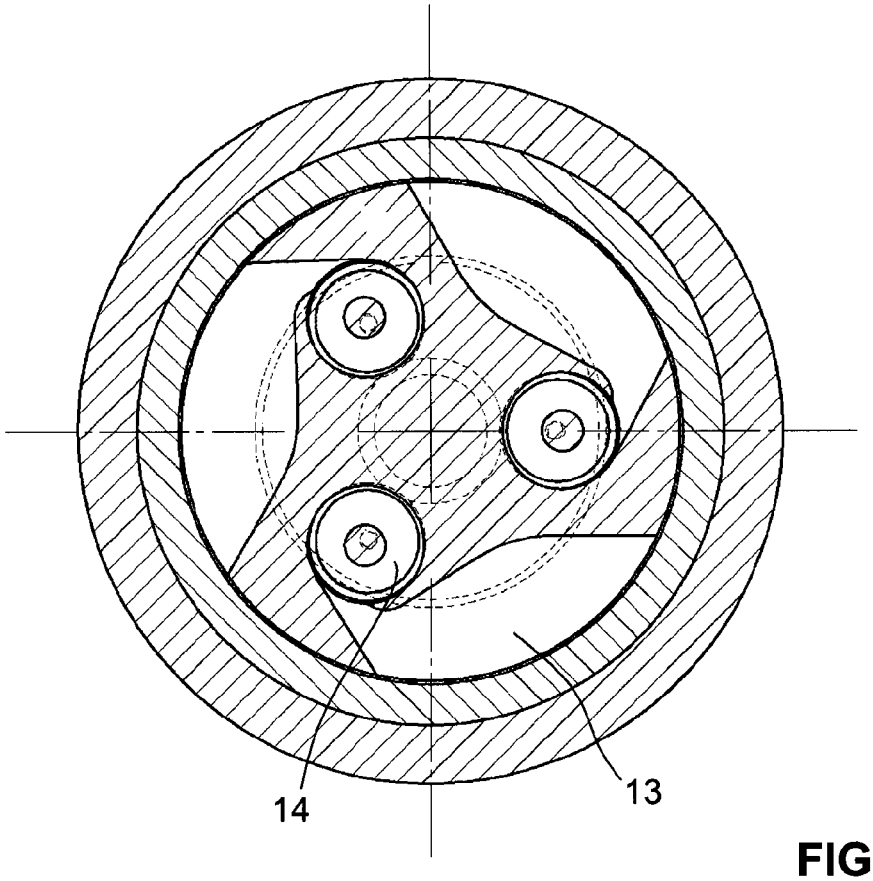
FIG. 10 shows the mouthpiece from FIG. 9 as seen in a cross section along plane E-E from FIG. 9.

A mouthpiece according to a third embodiment is illustrated in FIGS. 9 and 10. Once again, equivalent parts are provided with the same reference numerals as in the first embodiment. In this embodiment, the inflow channels 13 are shaped differently to those in the first two embodiments; in addition, the inflow channels, rather than being formed as depressions in the housing insert 5, are formed as depressions in the end face of the swirl plate 6. Instead of an arcuate shape of constant cross section, the inflow channels here are of fan-like shape with a cross section which tapers to a pronounced extent. This means that the water flow is also accelerated here in the inflow channels.

Figure 11:
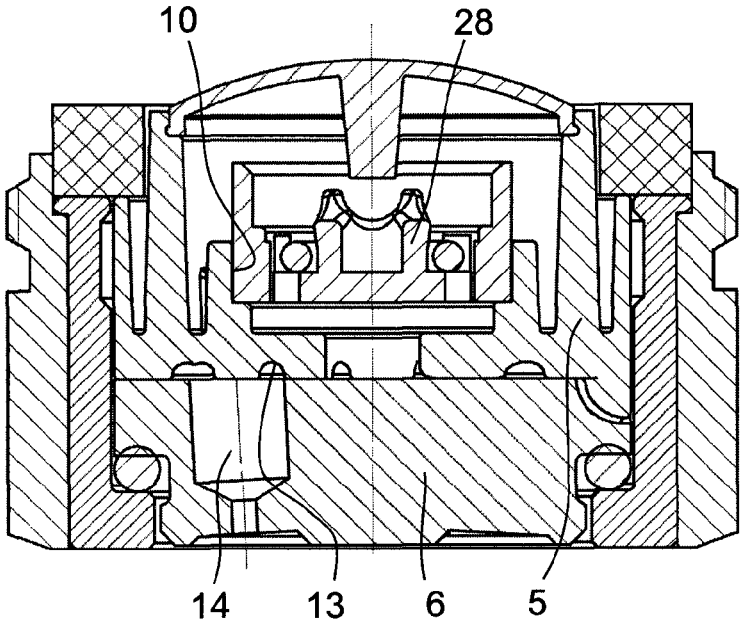
FIG. 11 shows a mouthpiece according to a fourth embodiment of the invention as seen in a central longitudinal section.

A mouthpiece according to a fourth embodiment is illustrated in FIG. 11. Once again, equivalent parts are provided with the same reference numerals as in the first embodiment. The cross section of the inflow channels 13 here is semicircular instead of rectangular. In addition, a commercially available flow restrictor 28 has been inserted in the central bore 10. This allows the mouthpiece to be adapted very straightforwardly, without the dimensioning being altered in any way, to relatively high flow pressures.

Figure 12:
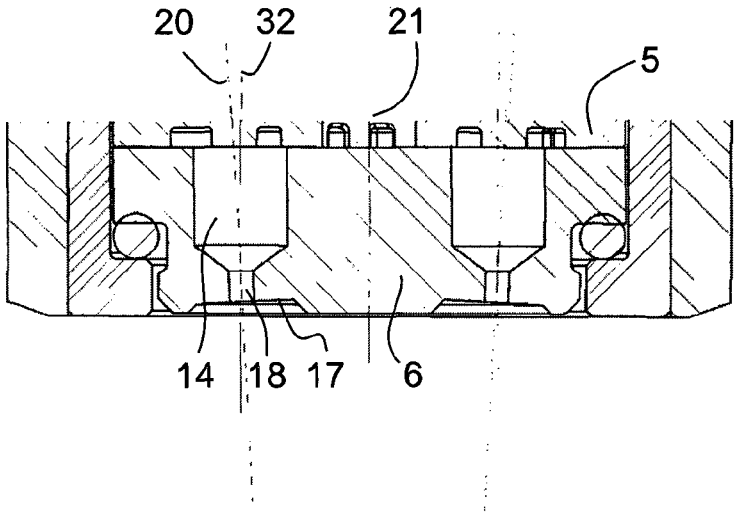
FIG. 12 shows a detail of a mouthpiece according to a fifth embodiment of the invention as seen in a longitudinal section along plane F-F from FIG. 2.

A mouthpiece according to a fifth embodiment of the invention is illustrated in FIG. 12. The construction of this mouthpiece corresponds largely to that of the first embodiment, and equivalent parts are provided, in turn, with the same reference numerals as in the first embodiment. This embodiment differs from the first embodiment in that the longitudinal chamber axis 32 of each swirl chamber does not coincide with the longitudinal nozzle axis 20 of the relevant swirl chamber. Instead, the longitudinal chamber axes 32 here run parallel to the longitudinal device axis 21, whereas only the longitudinal nozzle axes 20 are inclined by an angle of approximately 3° in the direction of the longitudinal device axis 21. This simplifies the production of the swirl plate 6 to a considerable extent: the swirl chambers 14 can be machined from above parallel to the longitudinal device axis 21 (or, in the case of injection molding, de-molded from above parallel to said axis). It is only the outlet nozzles 18 which need to be machined, or de-molded, as the case may be, from beneath at an angle to the longitudinal device axis 21.

Figure 13:
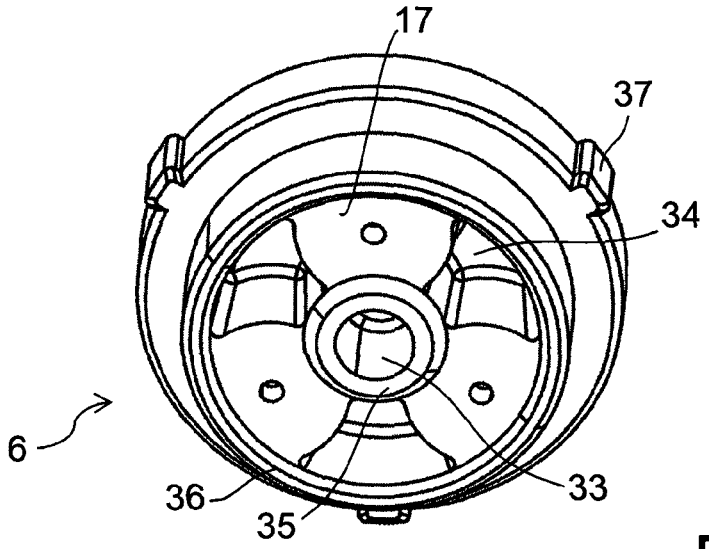
FIG. 13 shows a perspective view of a swirl plate for a mouthpiece according to a sixth embodiment of the invention.
Figure 14:
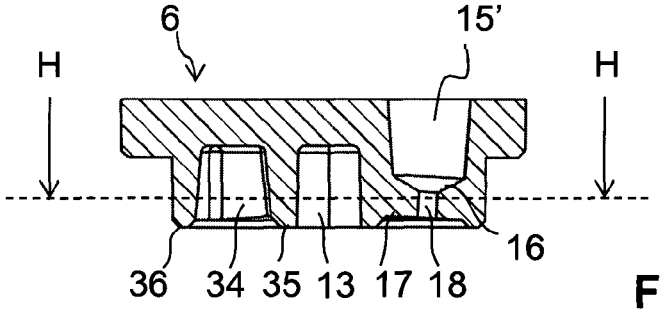
FIG. 14 shows the swirl plate from FIG. 13 as seen in a central longitudinal section along plane G-G from FIG. 15.
Figure 15:
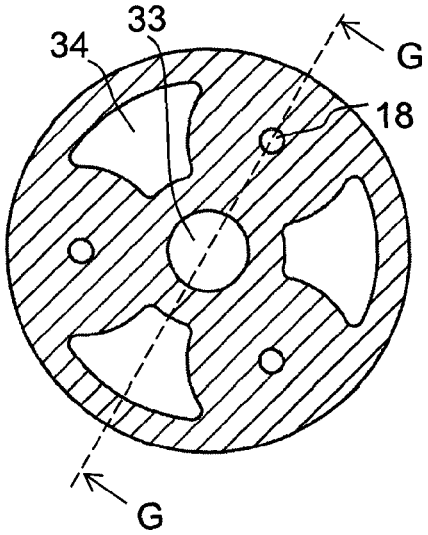
FIG. 15 shows the swirl plate from FIG. 13 as seen in the cross section along plane H-H from FIG. 14.

FIGS. 13-15 illustrate a further embodiment of a swirl plate 6. This swirl plate is formed in a manner very similar to the swirl plate of the first, fourth, or fifth embodiments. However, it differs from these embodiments in a few aspects which will be explained below.

In particular, the swirl plate of FIGS. 13-15 has, in the swirl chambers, transition regions 15' which taper slightly conically in the downward direction (see FIG. 14). Each transition region 15' forms a transition between the corresponding inflow region, which, as in the first, fourth, or fifth exemplary embodiments, is formed in the housing insert 5, and the conical region 16, which is followed by the outlet nozzle 18. Whereas, in the first to fifth exemplary embodiments above, the corresponding transition regions are precisely cylindrical, the transition regions in the present exemplary embodiment are slightly conical, in order to improve the de-molding capability for production by injection molding. The small opening angle, of less than 2×5°, of the resulting truncated cone, however, means that these transition regions are otherwise functionally equivalent to purely cylindrical transition regions.

There are further differences on the outlet side of the swirl plate. Whereas the swirl plate in the exemplary embodiments above is of largely solid design on the outlet side, the swirl plate of this embodiment has a plurality of depressions, in particular a central blind hole 33 and three depressions 34 between the exit surfaces 17. The depressions 34 border the exit surfaces 17 directly in the circumferential direction, and therefore the exit surfaces 17 themselves, in contrast to the examples above, are no longer formed by frustoconical depressions in the surrounding material. Rather, the surrounding material then forms just an inner ring 35 and an outer ring 36, which bound the exit surfaces in the radial direction. This configuration with blind hole 33 and depressions 34 is preferred for production reasons, since this means that the material thickness is not excessive anywhere, and therefore the swirl plate, when produced by injection molding, cools, and hardens, relatively uniformly.

Finally, the swirl plate of this exemplary embodiment also has, on its outer circumference, three positioning protuberances 37, which make it possible for the swirl plate 6 to be retained, independently of the housing insert 5, in a fixed orientation in the inner sleeve 4, corresponding guide grooves being provided in the inner sleeve. If the housing insert is provided with corresponding protuberances as well, there is no need for the swirl plate and the housing insert to interengage.

It can be seen from the above description that a large number of modifications are possible without departing from the scope of the invention. It is thus possible, in particular, for the device, rather than being formed as a mouthpiece for an outflow fitting, to be formed, for example, also as a showerhead or as insert for a showerhead. Depending on the application area and dimensions, it is possible for more or fewer than three swirl chambers to be arranged around the central device axis. In the case of a greater number of swirl chambers, it may be advantageous for different outlet nozzles to be inclined differently in relation to the longitudinal device axis, in order for the exiting jets to be distributed over a greater region. This may be desirable, for example, in the case of showerheads. It is also possible for the inflow channels to be designed differently than presented above, e.g., in the form of rectilinear channels of constant or variable cross section.

LIST OF REFERENCE NUMERALS

1 Mouthpiece
2 Outer sleeve
3 Connection thread
4 Inner sleeve (accommodating sleeve)
5 Housing insert (feed element)
6 Swirl plate (swirl-chamber element)
7 Particle filter
8 Seal
9 Seal
10 Central bore
11 Feed channel
12 Radial portion
13 Inflow channel
14 Swirl chamber
15, 15' Cylindrical region
16 Conical region
17 Exit surface
18 Outlet nozzle
19 Depression
20 Longitudinal nozzle axis
21 Longitudinal device axis
22 Protuberance
23 Snap-fit arm
25 Hollow stub
26 Bore
27 Central protuberance
28 Flow restrictor
29 Inflow region
30 Service unit
31 Through-passage
32 Longitudinal chamber axis
33 Blind hole
34 Depression
35 Inner ring
36 Outer ring
37 Positioning protuberance

The invention claimed is:

1. A device for spraying a pressurized liquid, comprising:

a central feed channel (11) for the liquid, the central feed channel running along a device axis (21);

a plurality of swirl chambers (14) arranged in a decentralized manner in relation to the device axis (21), wherein each of the swirl chambers has at least one inlet for feeding the liquid into the respective swirl chamber and an outlet nozzle (18) in order for a liquid jet to exit from the swirl chamber; and an arrangement of inflow channels (13), which connect the feed channel (11) to the swirl chambers (14) essentially transversely to the device axis (21), in order for a liquid flow entering into the device to be distributed between the inlets of the swirl chambers (14); wherein each of the outlet nozzles (18) defines a longitudinal nozzle axis (20) running at an angle of 1°-10° to the device axis, and wherein the longitudinal nozzle axes (20) are inclined in relation to one another such that liquid jets exiting from the outlet nozzles come into contact with one another at a predetermined distance from the outlet nozzles (18);

a feed element (5), in which the feed channel (11) is formed;

a swirl-chamber element (6), wherein the swirl chambers (14) are formed, at least in part, by depressions in the swirl-chamber element (6);

and the feed element (5) and the swirl-chamber element (6) are connected to one another such that, together, they bound at least one region of each of the inflow channels (13).

2. The device according to claim 1, wherein the feed element (5) rests on the swirl-chamber element (6).

3. The device according to claim 1, further comprising an accommodating sleeve (4), the feed element (5) and the swirl-chamber element (6) being retained together in the accommodating sleeve (4), and the feed element (5), the swirl-chamber element (6), and the accommodating sleeve (4) together form an exchangeable unit.

4. The device according to claim 3, wherein the swirl-chamber element (6) butts against an inner axial stop of the accommodating sleeve (4) directly or via a seal.

5. The device according to claim 4, wherein the feed element (5) rests on the swirl-chamber element (6) and is retained on the accommodating sleeve (4).

6. The device according to claim 5, wherein a snap-fit connection is formed between the feed element (5) and the accommodating sleeve (4).

7. The device according to claim 1, wherein the device is a mouthpiece of a sanitary outflow fitting.

8. The device according to claim 1, wherein each of the inflow channels (13), starting from the feed channel, initially runs essentially radially outwards.

9. The device according to claim 1, wherein each of the inflow channels (13), starting from the feed channel (11), describes an arc with an angle of at least 90°.

10. The device according to claim 9, wherein the arc describes an angle of at least 180°.

11. The device according to claim 1, wherein the device comprises at least three of the swirl chambers (14), the longitudinal nozzle axes of the swirl chambers being inclined in relation to one another.

12. The device according to claim 11, wherein the swirl chambers (14) are arranged in a ring around the central device axis (21).

13. The device according to claim 1, wherein each of the swirl chambers (14) defines a longitudinal chamber axis (32), the inlet of each of the swirl chambers (14) is formed in an inflow region (29) of the swirl chamber (14) such that the liquid is fed into the respective swirl chamber essentially tangentially in relation to the longitudinal chamber axis (32), the outlet nozzle (18) is arranged essentially centrally in relation to the longitudinal chamber axis (32), and the longitudinal nozzle axis (20) and the longitudinal chamber axis (32) assume an angle of 0° to 15° in relation to one another.

14. The device according to claim 13, wherein the longitudinal chamber axes (32) of the swirl chambers run essentially parallel to one another, and the longitudinal nozzle axes (20) are inclined in relation to the longitudinal chamber axes (32).

15. The device according to claim 13, wherein each of the swirl chambers has an essentially conical region (16) in which a cross section of the swirl chamber tapers continuously along the longitudinal chamber axis (32) to the outlet nozzle (18).

16. The device according to claim 15, wherein each swirl chamber has an essentially cylindrical region (15) which is arranged between the inflow region (29) and the conical region (16).

17. The device according to claim 13, wherein each of the swirl chambers (14) contains a protuberance (27) which extends centrally into the inflow region (29) of the swirl chamber (14), such that the inflow region (29) of the swirl chamber forms an annular cavity.

18. The device according to claim 1, wherein each of the inflow channels (13) has a rectangular cross section.

19. The device according to claim 1, wherein the inflow channels (13) are formed by depressions in the feed element (5), and the swirl-chamber element (6) has an end surface which is oriented towards the feed element (5) and is essentially planar in a region of the inflow channels (13).

20. The device according to claim 1, wherein at least one decentralized positioning protuberance (22) is formed on the feed element (5) or on the swirl-chamber element (6), said positioning protuberance engaging in a complementary positioning groove on the other of the feed element or the swirl-chamber element in order for the feed element (5) and the swirl-chamber element (6) to be positioned relative to one another.

* * * * *